US012116707B1

(12) United States Patent
Martelli

(10) Patent No.: US 12,116,707 B1
(45) Date of Patent: Oct. 15, 2024

(54) INFINITE THROAT SEWING MACHINE MATERIAL MOVEMENT APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 179 days.

(21) Appl. No.: 17/975,980

(22) Filed: Oct. 28, 2022

(51) Int. Cl.
*D05B 19/12* (2006.01)
*D05B 11/00* (2006.01)
*D05B 49/04* (2006.01)
*D05B 69/18* (2006.01)

(52) U.S. Cl.
CPC ..... *D05B 19/12* (2013.01); *D05B 11/00* (2013.01); *D05B 49/04* (2013.01); *D05B 69/18* (2013.01)

(58) Field of Classification Search
CPC ..... D05B 49/04; D05B 69/10; D05B 69/12; D05B 69/14; D05B 69/18; D05B 21/00; D05B 19/12; D05B 19/16
USPC ..... 112/117, 118, 119
See application file for complete search history.

(56) References Cited

U.S. PATENT DOCUMENTS 4,262,613 A * 4/1981 Landoni ..... D05B 11/00 112/102.5
5,178,081 A * 1/1993 von-Hagen ..... D05B 35/06 112/152
5,544,599 A * 8/1996 Frazer ..... D06H 7/02 112/475.08
6,026,756 A * 2/2000 Frazer ..... D05B 19/10 112/118
6,237,517 B1 * 5/2001 Bondanza ..... D05B 11/00 112/475.08
9,109,313 B2 * 8/2015 Bagley ..... D05B 21/00
11,247,864 B1 * 2/2022 Martelli ..... B65H 18/103
11,761,131 B2 * 9/2023 Bentley ..... D05B 21/00 112/102.5
2001/0052312 A1 * 12/2001 Codos ..... B41J 2/01 112/475.08
2002/0050117 A1 * 5/2002 Dasher ..... D05B 39/00 53/582
2005/0045083 A1 * 3/2005 Canan ..... D05B 11/00 112/117
2023/0167593 A1 * 6/2023 Bagley ..... D05B 11/00 112/118

(Continued)

FOREIGN PATENT DOCUMENTS

CN 212357570 U * 1/2021

*Primary Examiner* — Danny Worrell
(74) *Attorney, Agent, or Firm* — J. Nevin Shaffer, Jr.

(57) ABSTRACT

An infinite throat sewing machine material movement apparatus with a first roller where the first roller is connected with a first motor. A second roller is connected with a second motor, a first encoder pipe connected with a first encoder motor, a second encoder pipe connected with a second encoder motor; and a controller is connected with the first motor and the second motor and the first encoder motor and the second encoder motor. The controller operates the first motor and second motor to rotate the first roller in a first direction and the second roller in a second direction such that material connected with the first roller and the second roller is held at a selected tension and where the controller operates the first encoder motor and the second encoder motor to override the first motor and the second motor such that material connected with the first roller and the second roller moves in the first direction or in the second direction while maintaining the selected tension.

20 Claims, 3 Drawing Sheets

(56) References Cited

U.S. PATENT DOCUMENTS

2023/0220596 A1* 7/2023 Ramsay ..... D05B 69/30
112/475.08

* cited by examiner

INFINITE THROAT SEWING MACHINE MATERIAL MOVEMENT APPARATUS AND METHOD

CROSS REFERENCE TO RELATED APPLICATION

This application claims the benefit of previously filed U.S. provisional patent application No. 63/276,153 filed Nov. 5, 2021 for an "Infinite Throat Sewing Machine Material Movement Apparatus and Method". The Applicant hereby claims the benefit of this provisional application under 35 U.S.C. § 119. The entire content of this provisional application is incorporated herein by this reference.

FIELD OF THE INVENTION

This invention relates to an infinite throat sewing machine material movement apparatus and method. In particular, in accordance with one embodiment, the invention relates to an infinite throat sewing machine material movement apparatus with a first roller where the first roller is connected with a first motor. A second roller is connected with a second motor, a first encoder pipe connected with a first encoder motor, a second encoder pipe connected with a second encoder motor; and a controller is connected with the first motor and the second motor and the first encoder motor and the second encoder motor. The controller operates the first motor and second motor to rotate the first roller in a first direction and the second roller in a second direction such that material connected with the first roller and the second roller is held at a selected tension and where the controller operates the first encoder motor and the second encoder motor to override the first motor and the second motor such that material connected with the first roller and the second roller moves in the first direction or in the second direction while maintaining the selected tension.

BACKGROUND OF THE INVENTION

A problem exists with regard to the use of sewing machines. By way of example only and not by limitation, quilt makers use large supports with multiple rollers to feed and take up quilt materials so as to pass the materials beneath a sewing machine in order to create the quilt and whatever design the maker wishes to add. The prior art requires material to be pulled off the feed roller and taken up on a take up roller. The material moves in that direction only while the sewing machine moves left and right and forward and backward over the material. Forward motion of the sewing machine is limited by the depth of the throat of the machine, the distance from the front to the back of the machine, where the back is connected with the top and the bottom of the machine. As a result of this limitation, the creation of quilts, for example only, is time consuming and tedious and quilt designs are difficult to create due to the limited in an out range of the throat.

Thus, there is a need in the art for a sewing machine device that enables material to move in an unlimited manner underneath a sewing machine thus eliminating the movement restriction of the sewing machine throat.

It therefore is an object of this invention, among other things, to provide an improved "infinite" throat, sewing machine device which allows unlimited material movement beneath a sewing machine unrestrained by the throat of a sewing machine.

SUMMARY OF THE INVENTION

Accordingly, the infinite throat sewing machine material movement apparatus and method of the present invention, according to one embodiment, includes a first roller where the first roller is connected with a first motor. A second roller is connected with a second motor, a first encoder pipe connected with a first encoder motor, a second encoder pipe connected with a second encoder motor; and a controller is connected with the first motor and the second motor and the first encoder motor and the second encoder motor. The controller operates the first motor and second motor to rotate the first roller in a first direction and the second roller in a second direction such that material connected with the first roller and the second roller is held at a selected tension and where the controller operates the first encoder motor and the second encoder motor to override the first motor and the second motor such that material connected with the first roller and the second roller moves in the first direction or in the second direction while maintaining the selected tension.

All terms used herein are given their common meaning as easily understood with reference to the Figures described herein and the description that follows.

In one aspect, the first roller is a first feed and take up roller and where the second roller is a second feed and take up roller such that the first roller and the second roller operate to feed material back and forth between them.

In one aspect, the first direction and the second direction are the same but speed of rotation of said first roller and said second roller are not the same and in another aspect, the first direction is opposite from the second direction.

In one aspect, the invention further includes a sewing machine where the sewing machine is constrained in movement such that it only moves left and right as material is moved toward the sewing machine and away from the sewing machine.

In another aspect, the first roller and the second roller include a covering where the covering has a tacky surface such that material in contact with the covering does not slip on the tacky surface.

In one aspect, the first roller and the second roller and the first encoder pipe and the second encoder pipe include a covering where the covering has a tacky surface such that material in contact with the covering does not slip on the tacky surface.

In another aspect, the material consists of more than one layer of material. In one aspect, the material consists of three layers of material.

In a further aspect, the first roller and the second roller are reinforced with interior support rods.

According to another embodiment, an infinite throat sewing machine material movement apparatus consists of a support with a left side and a right side. A first feed and take up roller is connected with the support between the left side and the right side where the first feed and take up roller is connected with a first motor. A second feed and take up roller is connected with the support between the left side and the right side where the second feed and take up roller is connected with a second motor. A first encoder pipe is connected with the support between the left side and the right side where the first encoder pipe is connected with a first encoder motor. A second encoder pipe is connected with the support between the left side and the right side where the second encoder pipe is connected with a second encoder motor and a controller is connected with the first motor and the second motor and the first encoder motor and the second encoder motor where the controller operates the first motor and second motor to rotate the first feed and take up roller in a first direction and the second feed and take up roller in a second direction such that material connected with the first feed and take up roller and the second feed and take up roller is held at a selected tension and where the controller operates the first encoder motor and the second encoder motor to override the first motor and the second motor such that material connected with the first feed and take up roller and the second feed and take up roller moves in the first direction or in the second direction while maintaining the selected tension. A sewing machine is constrained in movement such that it only moves left and right between the left side and the right side as material is moved toward the sewing machine and away from the sewing machine.

In one aspect, the first feed and take up roller and the second feed and take up roller include a covering where the covering has a tacky surface such that material in contact with the covering does not slip on the tacky surface.

In one aspect, the first direction and the second direction are the same but speed of rotation of said first roller and said second roller are not the same and in another aspect, the first direction is opposite from the second direction.

In another aspect, the first feed and take up roller and the second feed and take up roller and the first encoder pipe and the second encoder pipe include a covering where the covering has a tacky surface such that material in contact with the covering does not slip on the tacky surface.

In one aspect, the material consists of more than one layer of material and in another aspect, the material consists of three layers of material.

In another aspect, the first feed and take up roller and the second feed and take up roller are reinforced with interior support rods.

According to another embodiment, an infinite throat sewing machine material movement method consists of:

a. providing first feed and take up roller where the first feed and take up roller is connected with a first motor; a second feed and take up roller where the second feed and take up roller is connected with a second motor; a first encoder pipe where the first encoder pipe is connected with a first encoder motor; a second encoder pipe where the second encoder pipe is connected with a second encoder motor; a controller connected with the first motor and the second motor and the first encoder motor and the second encoder motor wherein the controller operates the first motor and second motor to rotate the first feed and take up roller in a first direction and the second feed and take up roller in a second direction such that material connected with the first feed and take up roller and the second feed and take up roller is held at a selected tension and where the controller operates the first encoder motor and the second encoder motor to override the first motor and the second motor such that material connected with the first feed and take up roller and the second feed and take up roller moves in the first direction or in the second direction while maintaining the selected tension; and b. a sewing machine where the sewing machine is constrained in movement such that it only moves left and right as material is moved toward the sewing machine and away from the sewing machine.

In one aspect, the first direction and the second direction are the same but speed of rotation of said first roller and said second roller are not the same and in another aspect, the first direction is opposite from the second direction.

In one aspect, the first feed and take up roller and the second feed and take up roller include a covering where the covering has a tacky surface such that material in contact with the covering does not slip on the tacky surface.

In another aspect, the first feed and take up roller and the second feed and take up roller and the first encoder pipe and the second encoder pipe include a covering where the covering has a tacky surface such that material in contact with the covering does not slip on the tacky surface.

In one aspect, the material consists of more than one layer of material and in another aspect, the material consists of three layers of material.

In a further aspect, the first feed and take up roller and the second feed and take up roller are reinforced with interior support rods.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
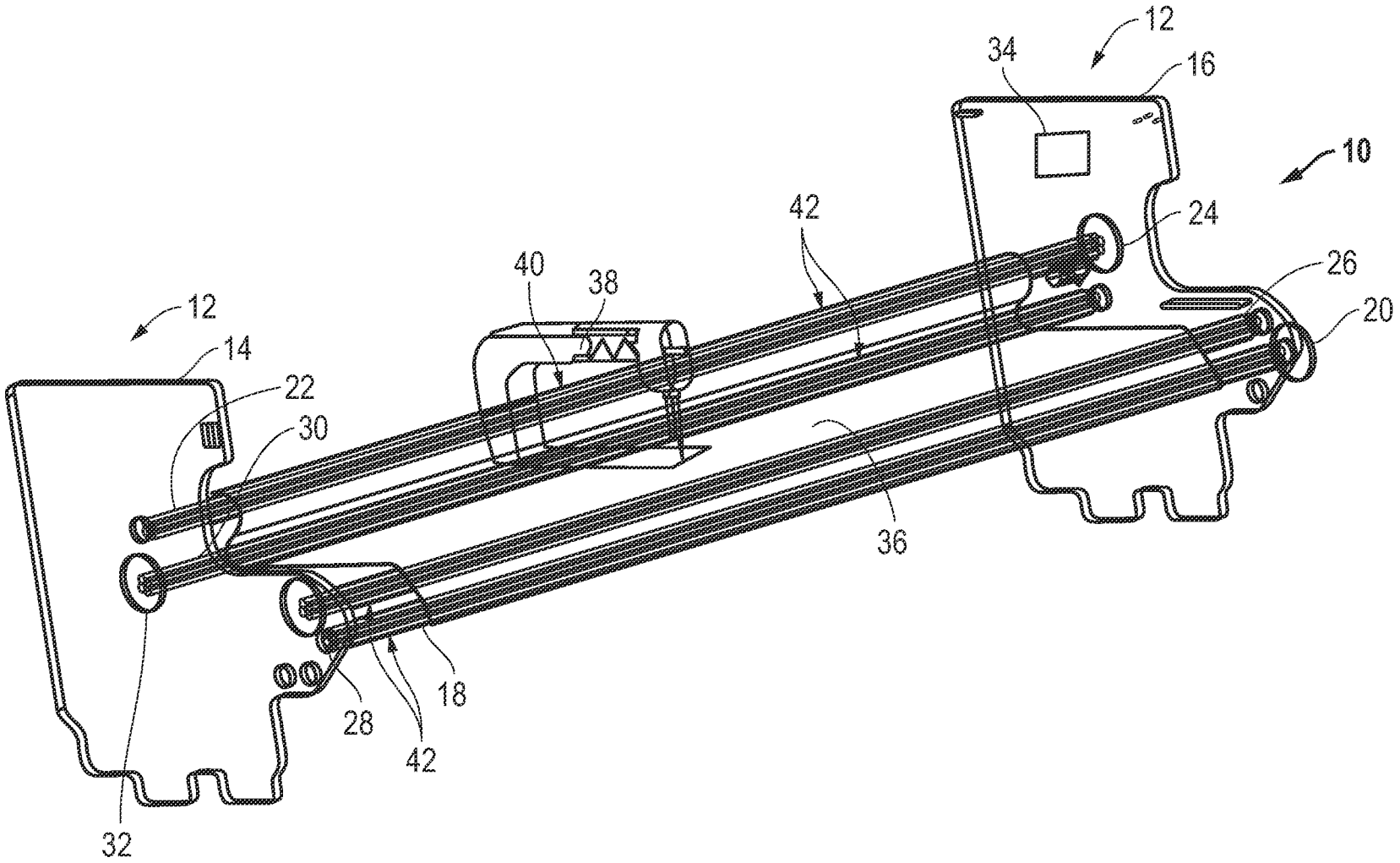
FIG. 1 is a see through perspective view of the infinite throat material movement apparatus of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

The preferred embodiment of the present invention is illustrated by way of example in FIGS. 1-4. With specific reference to FIGS. 1 and 2, infinite throat sewing machine material movement apparatus 10 consists of a support 12 with a left side 14 and a right side 16. A first feed and take up roller 18 is connected with the support 12 between the left side 14 and the right side 16 where the first feed and take up roller 18 is connected with a first motor 20. A second feed and take up roller 22 is connected with the support 12 between the left side 14 and the right side 16 where the second feed and take up roller 22 is connected with a second motor 24. A first encoder pipe 26 is connected with the support 12 between the left side 14 and the right side 16 where the first encoder pipe 26 is connected with a first encoder motor 28. A second encoder pipe 30 is connected with the support 12 between the left side 14 and the right side 16 where the second encoder pipe 30 is connected with a second encoder motor 32 and a controller 34 is connected with the first motor 20 and the second motor 24 and the first encoder motor 28 and the second encoder motor 32.

As used herein, an "encoder pipe" describes a pipe connected with an encoder motor. Encoder motors, as are known in the art, are rotary encoders adapted to provide information about an electric motor shaft's speed and/or position. Motor encoders are most commonly magnetic or optical and produce signals that are either incremental or absolute.

The controller 34 operates the first motor 20 and second motor 24 to rotate the first feed and take up roller 18 in a first direction and the second feed and take up roller 22 in a second direction such that material 36 connected with the first feed and take up roller 18 and the second feed and take up roller 22 is held at a selected tension. It should be understood that the first direction and the second direction may be the same direction of rotation but with one roller turning faster or slower than the other, or the first direction and the second direction may be opposite from each other, just so long as the selected tension is maintained.

As used herein, a controller 34 is a hardware device or a software program that manages or directs the flow of data between two entities. In computing, controllers may be cards, microchips or separate hardware devices for the control of a peripheral device. In a general sense, a controller can be thought of as something or someone that interfaces between two systems and manages communications between them.

Again, importantly, the controller 34 also operates the first encoder motor 28 and the second encoder motor 30 to rotate first encoder pipe 26 and second encoder pipe 30 so as to override tension set up between the first motor 20 and the second motor 24 such that material 36 connected with the first feed and take up roller 18 and the second feed and take up roller 22 moves in the first direction or in the second direction while maintaining the selected tension.

Figure 2:
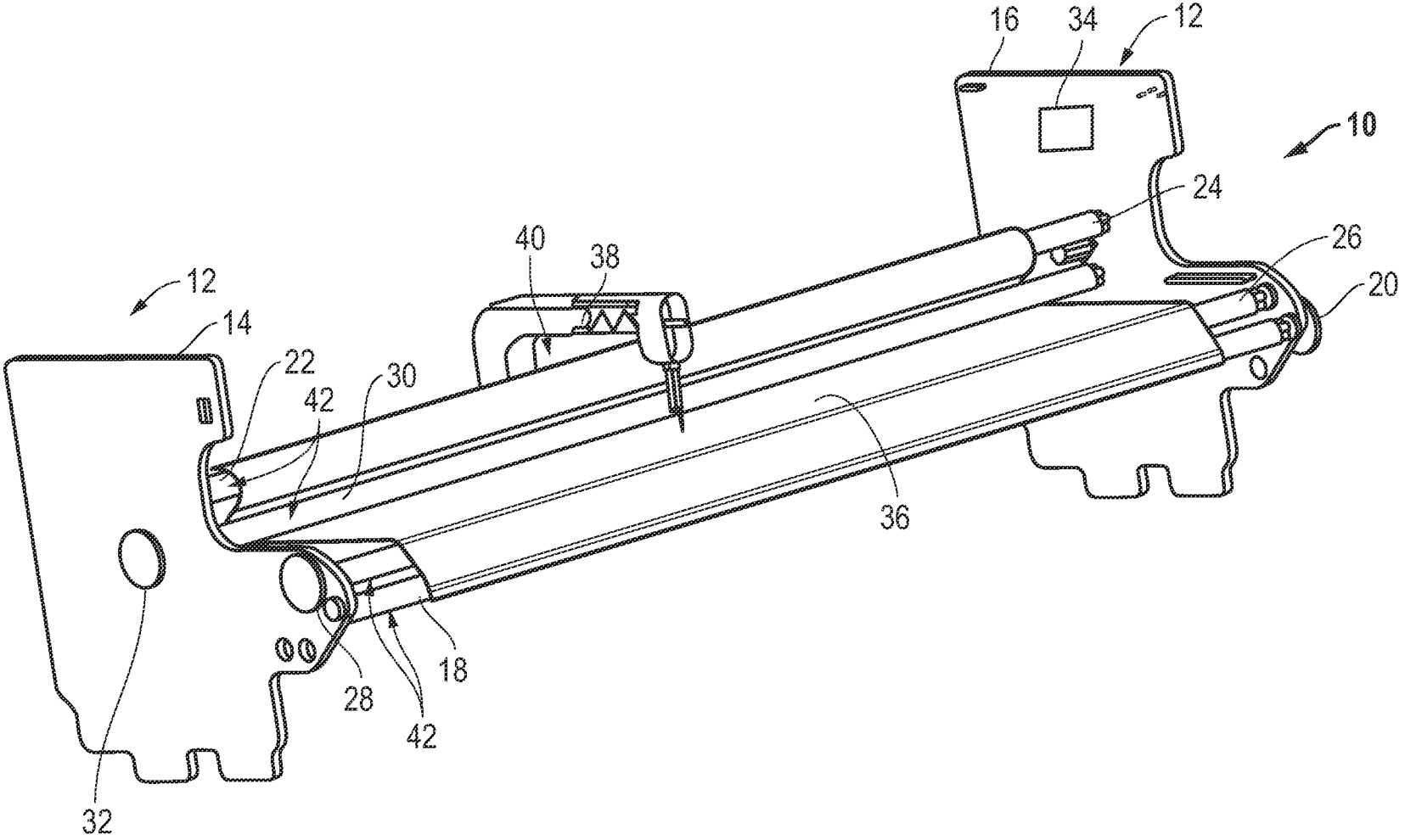
FIG. 2 is a perspective view of the invention of FIG. 1.

As shown in FIGS. 1 and 2, material 36 is loaded onto and off of first and second feed and take up rollers 18 and 22 while passing over, for example only and not by limitation, first encoder pipe 26 and under second encoder pipe 30. Thus, first encoder pipe 26 and second encoder pipe 30 under the operation of controller 34 control the movement of material 36 toward and away from sewing machine 38. In this manner, all of the material 36 used to create a quilt, for example only, can be reached by the sewing machine 38 and not be limited to the depth of the throat 40 of a sewing machine 38 as is the state of the art.

Sewing machine 38 is moveable left and right in the direction of the left side 14 and right side 16 of support 12 but otherwise does not move forward or back, at least to any appreciable degree. Instead, the user simply moves material 36 forward, toward second feed and take up roller 22 from first feed and take up roller 18, and/or backward, from second feed and take up roller 22 toward first feed and take up roller 18 while the sewing machine moves left and right from side to side to create the desired quilt and design, for example only.

In one aspect, the first feed and take up roller 18 and the second feed and take up roller 22 and the first encoder pipe 26 and the second encoder pipe 30 include a covering 42 where the covering 42 has a tacky surface such that material 36 in contact with the covering 42 does not slip on the tacky surface. Any tacky material that is sticky to the touch, that holds but releases material as is known in the art is suitable for the purposes of the invention. The tacky adhesive used in removably attachable notes, for example only and not by limitation, as well as a glue or rubber material, for example.

Figure 3:
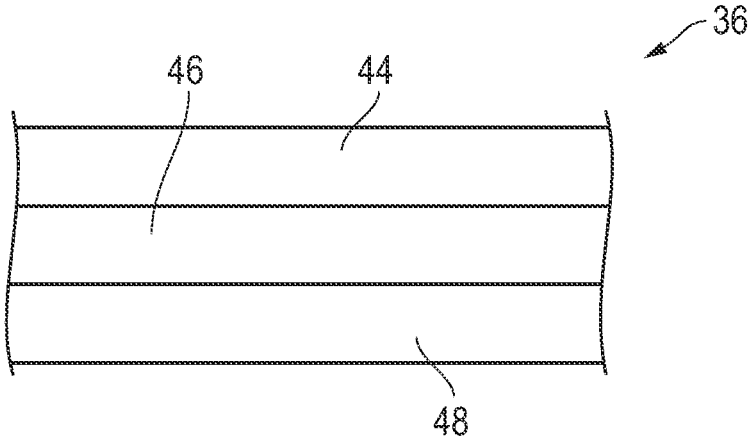
FIG. 3 is a side schematic view of material with more than one layer.

Referring now to FIG. 3, in many cases, material 36 used to create a quilt, for example only, includes more than one layer of material 36. Often, the material 36 consists of more than one layer of material such as a top layer 44, an interior padding layer 46 and a bottom layer 48. By way of the present invention, all three layers may be loaded onto first feed and take up roller 18 at the same time and moved, as described above. In fact, material 36 in any number of layers may be pre-loaded onto first feed and take up roller 18 and shipped to users of the present invention ready to go.

Figure 4:
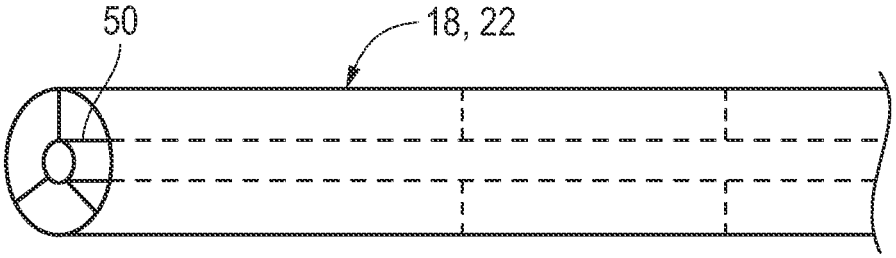
FIG. 4 is a perspective view of a reinforced interior support rod.

Referring to FIG. 4, Applicant has found that because material is moved back and forth, forward and backward, front to back, improved performance is achieved when the first feed and take up roller 18 and the second feed and take up roller 22 are reinforced with interior support rods 50. Interior support rods 50 are connected inside the feed and take up rollers 18 and 22 and add rigidity to them. Certainly, first and second encoder pipes 26 and 30 may be similarly reinforced. Solid pipes may be used as well but weight considerations are a concern.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An infinite throat sewing machine material movement apparatus comprising:

a. a first roller wherein the first roller is connected with a first motor;

b. a second roller wherein the second roller is connected with a second motor;

c. a first encoder pipe wherein the first encoder pipe is connected with a first encoder motor;

d. a second encoder pipe wherein the second encoder pipe is connected with a second encoder motor; and e. a controller connected with the first motor and the second motor and the first encoder motor and the second encoder motor wherein the controller operates the first motor and second motor to rotate the first roller in a first direction and the second roller in a second direction such that material connected with the first roller and the second roller is held at a selected tension and wherein the controller operates the first encoder motor and the second encoder motor to override the first motor and the second motor such that material connected with the first roller and the second roller moves in said first direction or in said second direction while maintaining said selected tension.

2. The apparatus of claim 1 wherein the first direction and the second direction are the same but speed of rotation of said first roller and said second roller are not the same.

3. The apparatus of claim 1 wherein the first direction is opposite from the second direction.

4. The apparatus of claim 1 wherein the first roller is a first feed and take up roller and wherein the second roller is a second feed and take up roller such that the first roller and the second roller operate to feed material back and forth between them.

5. The apparatus of claim 1 further including a sewing machine wherein the sewing machine is constrained in movement such that it only moves left and right as material is moved toward the sewing machine and away from the sewing machine.

6. The apparatus of claim 1 wherein the first roller and the second roller include a covering wherein the covering has a tacky surface such that material in contact with the covering does not slip on the tacky surface.

7. The apparatus of claim 1 wherein the first roller and the second roller and the first encoder pipe and the second encoder pipe include a covering wherein the covering has a tacky surface such that material in contact with the covering does not slip on the tacky surface.

8. The apparatus of claim 1 wherein the first roller and the second roller are reinforced with interior support rods.

9. An infinite throat sewing machine material movement apparatus comprising:

a. a support with a left side and a right side;

b. first feed and take up roller connected with the support between the left side and the right side wherein the first feed and take up roller is connected with a first motor;

c. a second feed and take up roller connected with the support between the left side and the right side wherein the second feed and take up roller is connected with a second motor;

d. a first encoder pipe connected with the support between the left side and the right side wherein the first encoder pipe is connected with a first encoder motor;

e. a second encoder pipe connected with the support between the left side and the right side wherein the second encoder pipe is connected with a second encoder motor;

f. a controller connected with the first motor and the second motor and the first encoder motor and the second encoder motor wherein the controller operates the first motor and second motor to rotate the first feed and take up roller in a first direction and the second feed and take up roller in a second direction such that material connected with the first feed and take up roller and the second feed and take up roller is held at a selected tension and wherein the controller operates the first encoder motor and the second encoder motor to override the first motor and the second motor such that material connected with the first feed and take up roller and the second feed and take up roller moves in said first direction or in said second direction while maintaining said selected tension; and f. a sewing machine wherein the sewing machine is constrained in movement such that it moves left and right between the left side and the right side as material is moved toward the sewing machine and away from the sewing machine.

10. The apparatus of claim 9 wherein the first feed and take up roller and the second feed and take up roller include a covering wherein the covering has a tacky surface such that material in contact with the covering does not slip on the tacky surface.

11. The apparatus of claim 9 wherein the first feed and take up roller and the second feed and take up roller and the first encoder pipe and the second encoder pipe include a covering wherein the covering has a tacky surface such that material in contact with the covering does not slip on the tacky surface.

12. The apparatus of claim 9 wherein the first direction and the second direction are the same but speed of rotation of said first roller and said second roller are not the same.

13. The apparatus of claim 9 wherein the first direction is opposite from the second direction.

14. The apparatus of claim 9 wherein the first feed and take up roller and the second feed and take up roller are reinforced with interior support rods.

15. An infinite throat sewing machine material movement method comprising:

a. providing first feed and take up roller wherein the first feed and take up roller is connected with a first motor; a second feed and take up roller wherein the second feed and take up roller is connected with a second motor; a first encoder pipe wherein the first encoder pipe is connected with a first encoder motor; a second encoder pipe wherein the second encoder pipe is connected with a second encoder motor; a controller connected with the first motor and the second motor and the first encoder motor and the second encoder motor wherein the controller operates the first motor and second motor to rotate the first feed and take up roller in a first direction and the second feed and take up roller in a second direction such that material connected with the first feed and take up roller and the second feed and take up roller is held at a selected tension and wherein the controller operates the first encoder motor and the second encoder motor to override the first motor and the second motor such that material connected with the first feed and take up roller and the second feed and take up roller moves in said first direction or in said second direction while maintaining said selected tension; and b. a sewing machine wherein the sewing machine is constrained in movement such that it moves left and right as material is moved toward the sewing machine and away from the sewing machine.

16. The method of claim 15 wherein the first feed and take up roller and the second feed and take up roller include a covering wherein the covering has a tacky surface such that material in contact with the covering does not slip on the tacky surface.

17. The method of claim 15 wherein the first feed and take up roller and the second feed and take up roller and the first encoder pipe and the second encoder pipe include a covering wherein the covering has a tacky surface such that material in contact with the covering does not slip on the tacky surface.

18. The method of claim 15 wherein the first direction and the second direction are the same but speed of rotation of said first roller and said second roller are not the same.

19. The method of claim 15 wherein the first direction is opposite from the second direction.

20. The method of claim 15 wherein the first roller and the second roller are reinforced with interior support rods.

* * * * *